US009153920B2

(12) United States Patent
Kamei et al.

(10) Patent No.: US 9,153,920 B2
(45) Date of Patent: Oct. 6, 2015

(54) PLUG CONNECTOR HAVING AN OVER-MOLDED CONTACT ASSEMBLY WITH A CONDUCTIVE PLATE BETWEEN TWO SETS OF ELECTRICAL CONTACTS

(71) Applicant: APPLE INC., Cupertino, CA (US)

(72) Inventors: Ibuki Kamei, Cupertino, CA (US); Albert J. Golko, Cupertino, CA (US); Eric S. Jol, Cupertino, CA (US); Eric T. SooHoo, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 30 days.

(21) Appl. No.: 14/025,675

(22) Filed: Sep. 12, 2013

(65) Prior Publication Data

US 2015/0072557 A1 Mar. 12, 2015

(51) Int. Cl.

| | |
|---|---|
| ***H01R 13/52*** | (2006.01) |
| ***H01R 24/60*** | (2011.01) |
| ***H01R 13/6581*** | (2011.01) |
| ***H01R 43/00*** | (2006.01) |
| ***H01R 13/655*** | (2006.01) |
| ***H01R 13/6596*** | (2011.01) |
| *H01R 13/6593* | (2011.01) |

(Continued)

(52) U.S. Cl.

CPC ..... *H01R 24/60* (2013.01); *H01R 13/5216* (2013.01); *H01R 13/655* (2013.01); *H01R 13/6581* (2013.01); *H01R 13/6596* (2013.01); *H01R 43/00* (2013.01); *H01R 13/6593* (2013.01); *H01R 13/6658* (2013.01); *H01R 43/005* (2013.01); *H01R 43/18* (2013.01); *H01R 43/24* (2013.01)

(58) Field of Classification Search

CPC ..... H01R 13/52; H01R 13/658
USPC ..... 439/519–521, 607.01–607.59
See application file for complete search history.

(56) References Cited

U.S. PATENT DOCUMENTS 7,497,733 B1 * 3/2009 Van der Steen ..... 439/607.01
7,674,128 B2 * 3/2010 Abe et al. ..... 439/519

(Continued)

FOREIGN PATENT DOCUMENTS

DE 202013003895 U1 7/2013
EP 2590273 A2 5/2013

(Continued)

OTHER PUBLICATIONS

International Search Report and Written Opinion for International PCT Application No. PCT/US2014/044031, mailed Sep. 15, 2014, 12 pages.

(Continued)

*Primary Examiner* — Chandrika Prasad
(74) *Attorney, Agent, or Firm* — Kilpatrick Townsend & Stockton LLP

(57) ABSTRACT

A dual orientation plug connector having a tab portion with first and second opposing exterior surfaces that are substantially identical, parallel and opposite each other. Each exterior surface may have a plurality of electrical contacts. A substantially u-shaped metallic band surrounds a portion of the periphery of the plug connector. A contact assembly having an upper contact carrier, intermediate conductive plate and lower contact carrier may be disposed within the tab portion of the plug connector. A circuit assembly may be disposed within a body portion of the plug connector and electrically coupled to the plurality of electrical contacts.

20 Claims, 9 Drawing Sheets

(51) Int. Cl.

| | |
|---|---|
| *H01R 13/66* | (2006.01) |
| *H01R 43/18* | (2006.01) |
| *H01R 43/24* | (2006.01) |

(56) References Cited

U.S. PATENT DOCUMENTS

| | | | | |
|---|---|---|---|---|
| 8,517,751 | B1 | 8/2013 | Golko et al. | |
| 2009/0163071 | A1 | 6/2009 | Chen | |
| 2011/0256761 | A1* | 10/2011 | Wu | 439/580 |
| 2011/0256764 | A1* | 10/2011 | Wu | 439/607.01 |
| 2012/0071033 | A1 | 3/2012 | Wu | |
| 2013/0157517 | A1 | 6/2013 | Liang | |
| 2014/0213110 | A1* | 7/2014 | Wu et al. | 439/607.22 |

FOREIGN PATENT DOCUMENTS

| | | | |
|---|---|---|---|
| WO | 2008065659 | A2 | 6/2008 |
| WO | 2011150403 | A1 | 12/2011 |

OTHER PUBLICATIONS

Office Action for Chinese Patent Application No. 201420464568.4, mailed Nov. 13, 2014, 2 pages.

* cited by examiner

PLUG CONNECTOR HAVING AN OVER-MOLDED CONTACT ASSEMBLY WITH A CONDUCTIVE PLATE BETWEEN TWO SETS OF ELECTRICAL CONTACTS

BACKGROUND OF THE INVENTION

The present invention relates generally to electrical connectors and in particular to electrical connectors for electronic devices. A wide variety of electronic devices are available for consumers today. Many of these devices have connectors that facilitate communication with and/or charging of a corresponding device. These connectors often interface with other connectors through cables that are used to connect devices to one another. Sometimes, connectors are used without a cable to directly connect the device to another device, such as a charging station or a sound system.

As smart-phones, media players and other electronic devices become more compact, a limiting factor on the size of a particular device may be one or more of the connectors incorporated into the device. As an example, receptacle connectors are sometimes positioned on one or more of the side surfaces of portable media devices. The thickness of such portable media devices may be limited by the thickness of the receptacle connector or connectors incorporated into the device. Smaller and thinner receptacle connectors may allow the portable media device to be designed smaller. Since such receptacle connectors typically include contacts positioned within an insertion cavity that is sized to hold a corresponding plug connector, there is a desire to have the mating plug connector smaller and thinner as well. Some plug connectors, such as a standard USB 2.0 connector, include a metal shield that surrounds the plug connector contacts forming a cavity in which the contacts are positioned. The shield may provide some level of protection against electrical interference but adds to the overall thickness of the portion of the plug connector that is inserted into the receptacle.

New connectors that such as external contact connectors as well as other connectors, may require new features and/or changes to commonly used connector components to be manufactured to more precise tolerances associated with the smaller size and to withstand the rigors of everyday use over multiple thousands of use cycles.

BRIEF SUMMARY OF THE INVENTION

Embodiments of the invention pertain to electronic plug connectors for use with a variety of electronic devices. In some embodiments the electronic plug connectors are configured to provide reduced size and cost.

Some embodiments of the present invention relate to improved plug connectors that have a reduced plug length and thickness and an intuitive insertion orientation and a smooth, consistent feel when inserted and extracted from its corresponding receptacle connector. Additionally, some embodiments of plug connectors according to the present invention only include external contacts and do not include contacts positioned within an internal cavity that is prone to collecting and trapping debris.

One particular embodiment of the invention pertains to an unpolarized multiple orientation plug connector having external contacts carried by a connector tab. The connector tab can be inserted into a corresponding receptacle connector in at least two different insertion orientations. Contacts are formed on first and second exterior surfaces of the tab and arranged in a symmetrical layout so that the contacts align with contacts of the receptacle connector in either of at least two insertion orientations. The connector tab itself can have a symmetrical cross-sectional shape to facilitate the multi-orientation aspect of this embodiment.

Another embodiment pertains to a dual orientation plug connector that includes a tab portion and a body portion. The tab portion may have 180 degree symmetry and be connected to and extend longitudinally away from the body portion. A substantially u-shaped metallic band surrounds a portion of the periphery of the plug connector. The metallic band may have retention features formed in opposing first and second side surfaces. The tab portion may have first and second exterior surfaces that are substantially identical, parallel and opposite each other. A contact assembly having an upper contact carrier, intermediate conductive plate and lower contact carrier may be disposed within the tab portion of the plug connector. The contact assembly may be configured to have plurality of external elongated electrical contacts disposed on the first and second exterior surfaces of the tab portion. A circuit assembly may be disposed within the body portion of the plug connector and electrically coupled to the electrical contacts. The circuit assembly may be overmolded within the u-shaped metallic band. Some embodiments may be particularly suited for low-cost highly automated manufacturing.

To better understand the nature and advantages of the present invention, reference should be made to the following description and the accompanying figures. It is to be understood, however, that each of the figures is provided for the purpose of illustration only and is not intended as a definition of the limits of the scope of the present invention. Also, as a general rule, and unless it is evident to the contrary from the description, where elements in different figures use identical reference numbers, the elements are generally either identical or at least similar in function or purpose.

DETAILED DESCRIPTION OF THE INVENTION

Certain embodiments of the present invention relate to electrical connectors. While the present invention can be useful to produce a wide variety of electrical connectors, some embodiments of the invention are particularly useful for producing connectors that are especially small, as described in more detail below.

Figure 1:
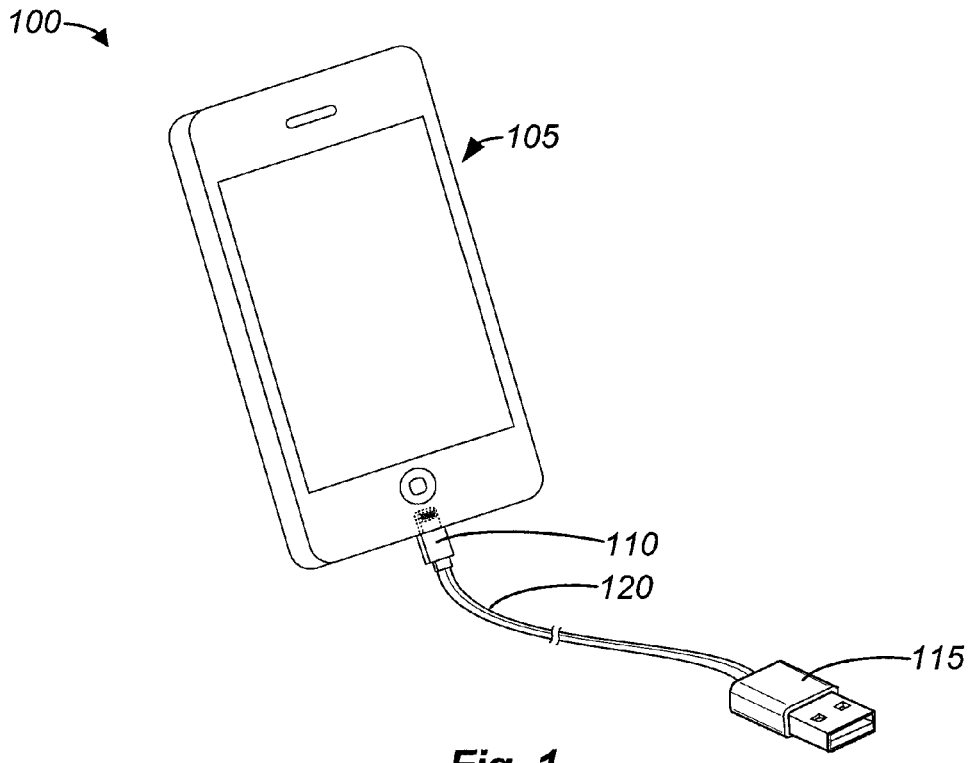
FIG. 1 is a front perspective view of a cable connected to a media player.

Many electronic devices such as smart-phones, media players, and tablet computers have connectors that facilitate battery charging and/or communication with other devices. The connectors include a plurality of electrical contacts through which electrical connections are made to another compatible connector to transfer power and/or data signals through the connectors. FIG. 1 illustrates an example of two such connectors including an external contact plug connector 110 and an internal contact connector 115. Each of these connectors 110, 115 may comply with a well-known standard such as Universal Serial Bus (USB) 2.0, Firewire, Thunderbolt, or the like or may be proprietary connectors, such as the 30-pin connector used on many Apple products among other types of proprietary connectors.

As further shown in FIG. 1, external contact plug connector 110 is inserted into an electronic device 105 and coupled by a cable 120 to internal contact connector 115. When external contact plug connector 110 is mated with electronic device 105, contacts within the plug connector (not shown in FIG. 1) are in physical and electrical contact with contacts in the electronic device to allow electrical signals to be transferred between the electronic device and a peripheral device. Internal contact connector 115 may be coupled with a peripheral device that can be any of myriad electronic devices or accessories that operate with electronic device 105.

Figure 2A:
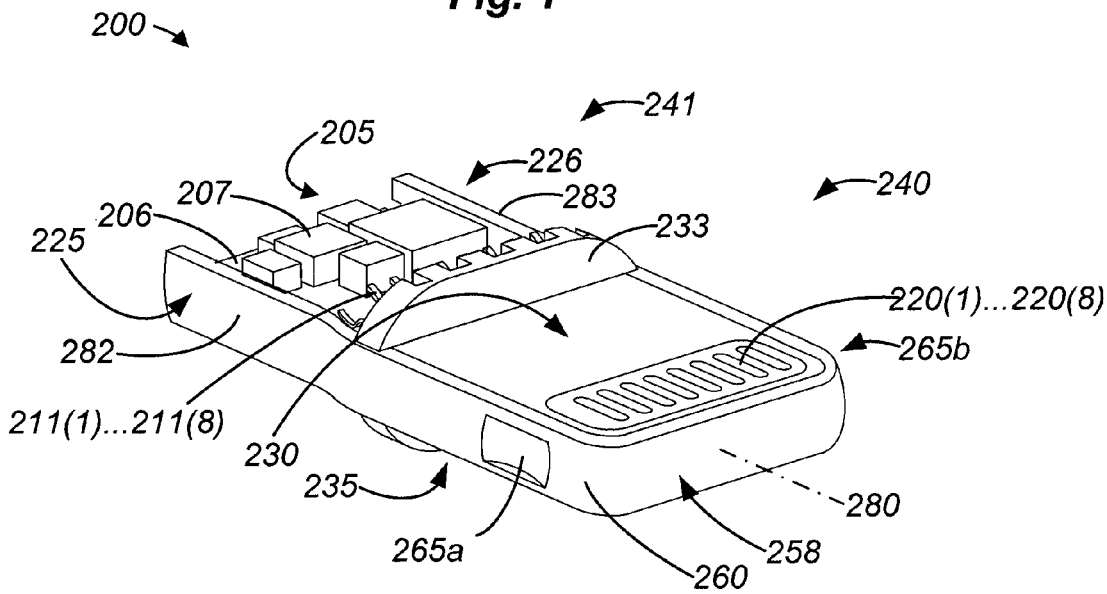
FIG. 2A is a front perspective view of a dual orientation plug connector.
Figure 2B:
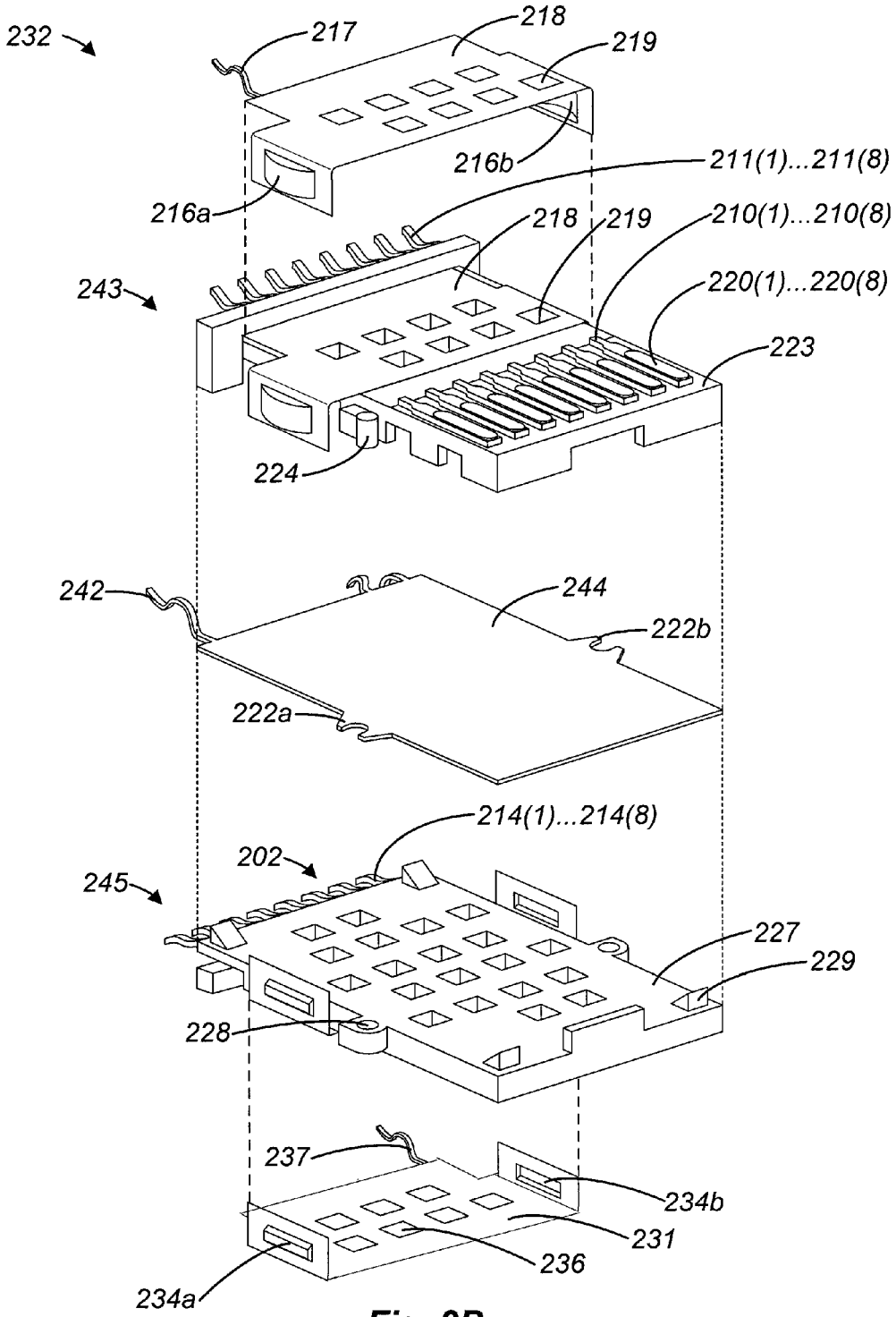
FIG. 2B is a front exploded perspective view of a contact assembly.

As an example, reference is made to FIGS. 2A and 2B, which depict simplified views of an axisymmetric dual orientation plug connector 200 that can be used as external contact plug connector 110 shown in FIG. 1. Connector 200 includes a connector tab 240 that is sized to be inserted into a cavity in a corresponding receptacle connector (not shown). In some embodiments, tab 240 is between 5-10 mm wide, between 1-3 mm thick and has an insertion depth (the distance from the tip of tab 240 to close out 233) of between 5-15 mm. Also in some embodiments, tab 240 has a length that is greater than its width which is greater than its thickness. In other embodiments, the length and width of tab 240 are within 0.2 mm of each other. In one particular embodiment, tab 240 is 6.7 mm wide, 1.5 mm thick and has an insertion depth (the distance from the tip of tab 240 to close out 233) of 6.6 mm. In other embodiments, tab 240 has the same 6.7 mm width and 1.5 mm height but a longer length.

Tab 240 includes a substantially u-shaped metallic band 260 that surrounds a portion of the periphery of connector 200. Metallic band 260 extends along an entire length of tab portion 248 and includes first and second opposing extensions 282, 283 bent inward within body portion 249. In some embodiments, the reduced width of connector 200 in this area may be used to accommodate an enclosure and/or a shield as described in more detail below. In some embodiments, metallic band 260 may provide mechanical strength and durability to connector 200 to survive many mating cycles. Metallic band 260 may have retention features 265*a*, 265*b* formed in opposing first side surface 225 and second side surface 226 (shown in FIG. 2A on first side surface 225 only). Retention features 265*a*, 265*b* may be part of a retention system that includes one or more features on plug connector 200 that are adapted to engage with one or more features on the corresponding receptacle connector to secure the connectors together when the plug connector is inserted into the receptacle connector. In some embodiments, retention features 265*a*, 265*b* may also be used as ground contacts that receive a ground signal from the receptacle connector. In further embodiments, metallic band 260 may be used to improve signal integrity and reduce signal interference in connector 200. In the illustrated embodiment, retention features 265*a*, 265*b* may be semi-circular indentations in first and second side surfaces 225, 226 of tab 240. Retention features 265*a*, 265*b* may be widely varied and may include angled indentations or notches, pockets that are formed only within metallic band 260. The retention system, including retention features 265*a*, 265*b* and the corresponding retention mechanism on the receptacle connector, can be designed to provide specific insertion and extraction forces such that the retention force required to insert the plug connector into the receptacle connector is higher than the extraction force required to remove the plug connector from the receptacle connector.

A contact assembly 232 (see FIG. 2B) is disposed within metallic band 260 and overmolded with encapsulant. Contact assembly 232 includes upper leadframe set 201 and lower leadframe set 202 that are overmolded with dielectric plastic material forming upper contact carrier 243 and lower contact carrier 245. Intermediate conductive plate 244 is disposed between upper contact carrier 243 and lower contact carrier 245. In some embodiments, intermediate conductive plate 244 provides shielding between upper leadframe set 201 and lower leadframe set 202. Particularly in embodiments where leadframe sets 201, 202 are closely spaced and sensitive signals need to be isolated from power leads and/or there are sensitive signals that need to be isolated from external noise sources and/or signals require a particular impedance to ground. Upper shield 218 and lower shield 231 are disposed around upper and lower contact carriers 243, 245 forming an external shield around contact assembly 232 isolating sensitive signals from external noise sources and/or isolating noisy internal signals from sensitive external devices. Contact assembly 232 may be particularly useful in applications requiring a low cost method of assembly for high volume applications.

Referring back to FIG. 2A, tab 240 may have a first exterior surface 230 and a second exterior surface 235 that are substantially identical, parallel and opposite each other. Exterior surfaces 230, 235 may each have a plurality of external elongated electrical contacts 220(1) . . . 220(8) (shown in FIG. 2A on first exterior surface 230 only). Other embodiments may have more or less electrical contacts. Contacts 220(1) . . . 220(8) can be raised, recessed or flush with first and second exterior surfaces 230, 235 of tab 240 and positioned within contact regions such that when the tab is inserted into a corresponding receptacle connector the contacts can be electrically coupled to corresponding contacts in the receptacle connector. In some embodiments, contacts 220(1) . . . 220(8) are self-cleaning wiping contacts that, after initially coming into contact with a receptacle connector contact during a mating event, slide further past the receptacle connector contact with a wiping motion before reaching a final, desired contact position. In some embodiments, individual contacts may be sized differently. This may be particularly useful, for example, where one or more contacts are dedicated to carry high power or high current. While FIG. 2A shows a single row of contacts 220(1) . . . 220(8), some embodiments of the invention may include two, three or more rows of contacts. Contacts 220(1) . . . 220(8) can be made from copper, nickel, brass, stainless steel, a metal alloy or any other appropriate conductive material or combination of conductive materials. Contacts 220(1) . . . 220(8) may also be plated with a metal layer to improve wear resistance, improve contact resistance and/or to improve resistance to corrosion.

While tab 240 is shown in FIG. 2A as having a substantially rectangular and substantially flat shape, in some embodiments of the invention first and second external surfaces 230, 235 may have matching convex or concave curvatures to them or may have a matching recessed region centrally located between the sides of tab 240. Contact regions may be formed in the recessed regions and the recessed regions may, for example, extend from the distal tip of tab 240 all the way to close out 233, or may extend along only a portion of the length of tab 240 (e.g., between ½ to ¾ of the length of the tab) ending at a point short of close out 233. First and second side surfaces 225, 226 may also have matching convex or concave curvatures.

Generally, the shape and curvature of first and second exterior surfaces 230, 235 mirror each other, as do the shape and curvature of first and second side surfaces 225 and 226, in accordance with the dual orientation design of connector 200 as described below. Additionally, while FIG. 2A shows first and second side surfaces 225, 226 as having a width significantly less than that of first and second exterior surfaces 230, 235 (e.g., less than or equal to one quarter or one half the width of first and second exterior surfaces 230, 235), in some embodiments of the invention first and second side surfaces 225, 226 have a width that is relatively close to or even equal with or wider than that of first and second exterior surfaces 230, 235.

This particular embodiment of connector 200 may be symmetric about longitudinal axis 280, such that it has two orientations that it can be mated with a matching receptacle connector including a first orientation and a second orientation that is rotated 180 degrees about longitudinal axis 280 relative to the first orientation. To allow for an orientation agnostic feature of connector 200, the connector may not be polarized. That is, connector 200 may not include a physical key configured to mate with a matching key in a corresponding receptacle connector and ensure that mating between the two connectors occurs only in a single orientation. Connector 200 may have a symmetrical arrangement of contacts on first and second exterior surfaces 230, 235 allowing contacts 220(1) . . . 220(8) of the plug connector to properly align with the contacts in the receptacle connector, regardless of orientation. In other dual orientation embodiments, the cross-sectional shape of tab 240 need not be fully symmetrical as long as the connector does not include a key that prevents the connector from being inserted into a corresponding receptacle connector in two different orientations and the contacts align properly in either orientation with contacts in the corresponding receptacle connector.

In addition to the 180 degree symmetrical, dual orientation design, plug connectors according to some embodiments of the invention electrically connect each contact formed at first exterior surface 230 of the connector with a corresponding contact on second exterior surface 235 on the opposite side of the connector. That is, in some embodiments of the invention, every contact in first exterior surface 230 is electrically connected to a corresponding contact in second exterior surface 235. Thus, any given signal that is to be carried by the plug connector is sent over a contact within first exterior surface 230 as well as a contact within second exterior surface 235. The effect of this aspect of some embodiments of the invention is that the number of different signals that can be carried by a given number of contacts is reduced by half as compared to if the contacts formed in first and second exterior surfaces 230, 235 were electrically isolated from each other and designated for different signals. This feature provides a benefit, however, in that the corresponding receptacle connector need only have contacts on one surface within its cavity (for example, a top surface or a bottom surface). The receptacle connector can thus be made thinner than a receptacle connector with contacts on both the top and bottom surfaces of its cavity, which in turn, enables an electronic device in which the receptacle connector is housed to be thinner as well.

In some embodiments the orientation of plug connector 200 can be detected based on a physical orientation key (different from a polarization key in that an orientation key does not prevent the plug connector from being inserted into the receptacle connector in multiple orientations) that, depending on the orientation of the plug connector, engages or does not engage with a corresponding orientation contact in the receptacle connector. Circuitry connected to the orientation contact can then determine which of the two possible orientations plug connector 200 was inserted into the receptacle connector. In other embodiments, orientation of plug connector 200 can be determined by detecting a characteristics (e.g., voltage or current level) at one or more of the contacts or by sending and receiving signals over one or more of the contacts using a handshaking algorithm. Circuitry within the host device that is operatively coupled to the receptacle connector can then set software and/or hardware switches to properly match the receptacle connector's contacts to the contacts of the plug connector.

As further illustrated in FIG. 2A, in one embodiment, within a body 241 of connector 200 is a circuit assembly 205 that is disposed within metallic band 260 and coupled to contacts 220(1) . . . 220(8) through termination portions 211(1) . . . 211(8). One or more electronic components 207 can be operatively coupled to PCB 206 to provide information regarding connector 200 and any accessory or device that connector 200 is part of and/or to perform specific functions, such as authentication, identification, contact configuration and current or power regulation. Electronic components 207 may include any other type of active or passive electronic device, such as, but not limited to an application specific integrated circuit, memory, transistor, capacitor, inductor and/or a resistor.

Also, the embodiment shown in FIG. 2A includes connector 200 as part of a cable connector. In other embodiments, plug connectors according to the invention are used in devices such as docking stations, clock radios and other accessories or electronic devices. In such embodiments, tab 240 may extend directly out of a housing associated with the docking station, clock radio or other accessory or electronic device. The housing associated with the accessory or device, which may be shaped very differently than body 241, can then be considered the body of the connector.

Assembly Steps

Figure 2C:
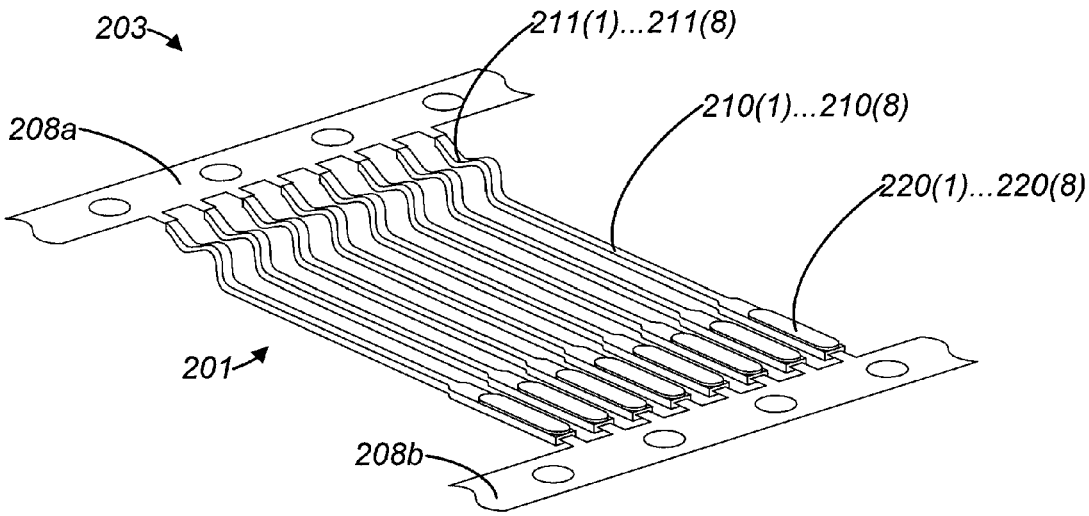
FIG. 2C is a front perspective view of upper leadframe.
Figure 2D:
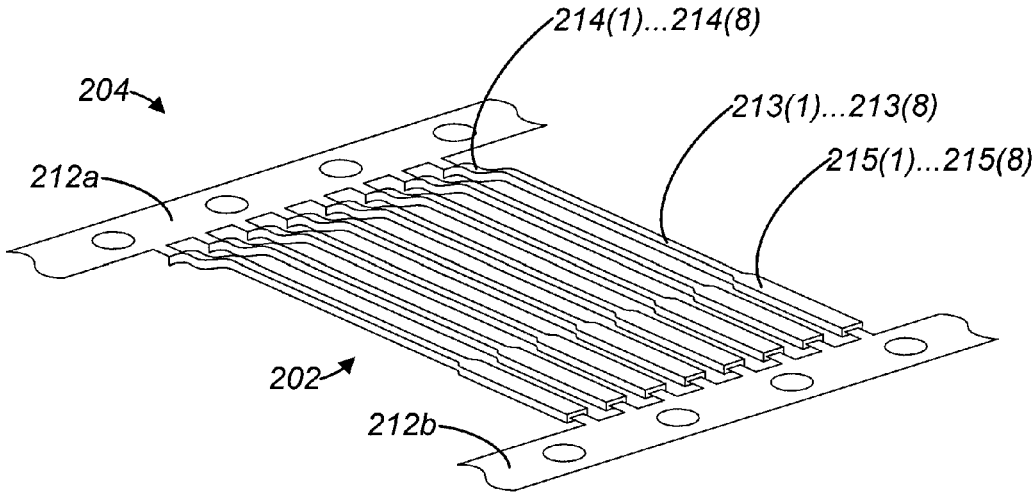
FIG. 2D is a front perspective view of lower leadframe.
Figure 2E:
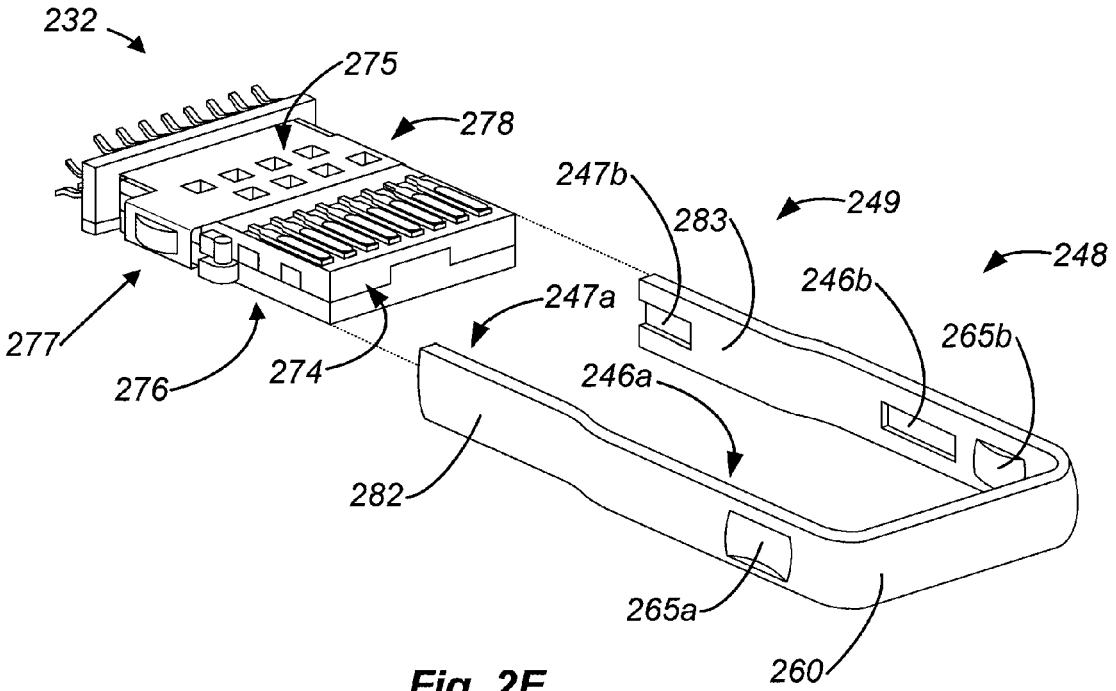
FIG. 2E is a front perspective view of a partially assembled dual orientation plug connector.
Figure 2F:
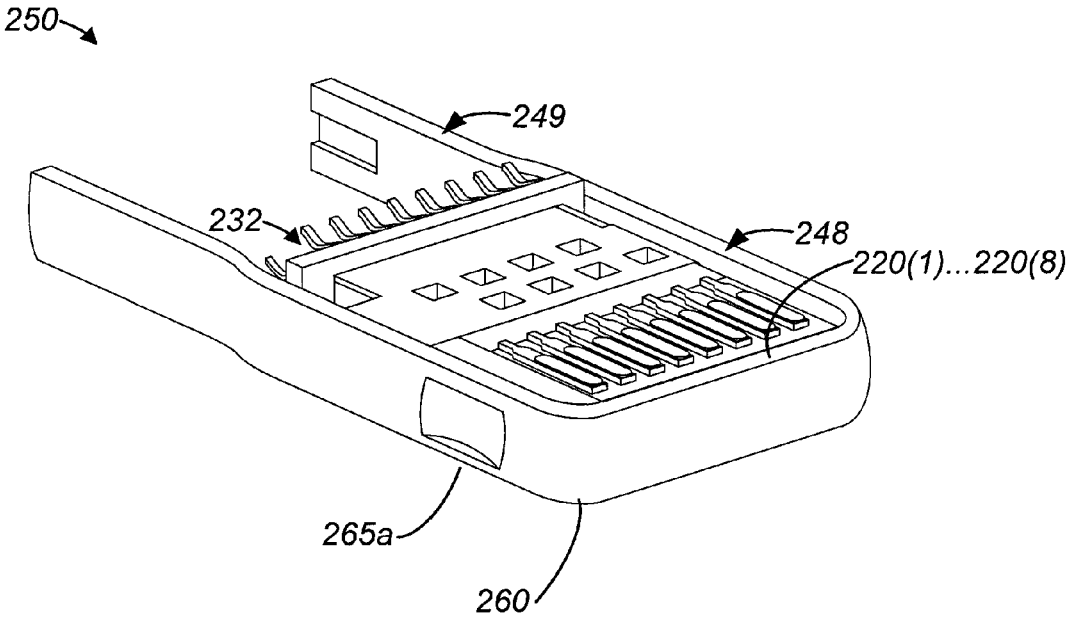
FIG. 2F is a front perspective view of a partially assembled dual orientation plug connector.
Figure 2G:
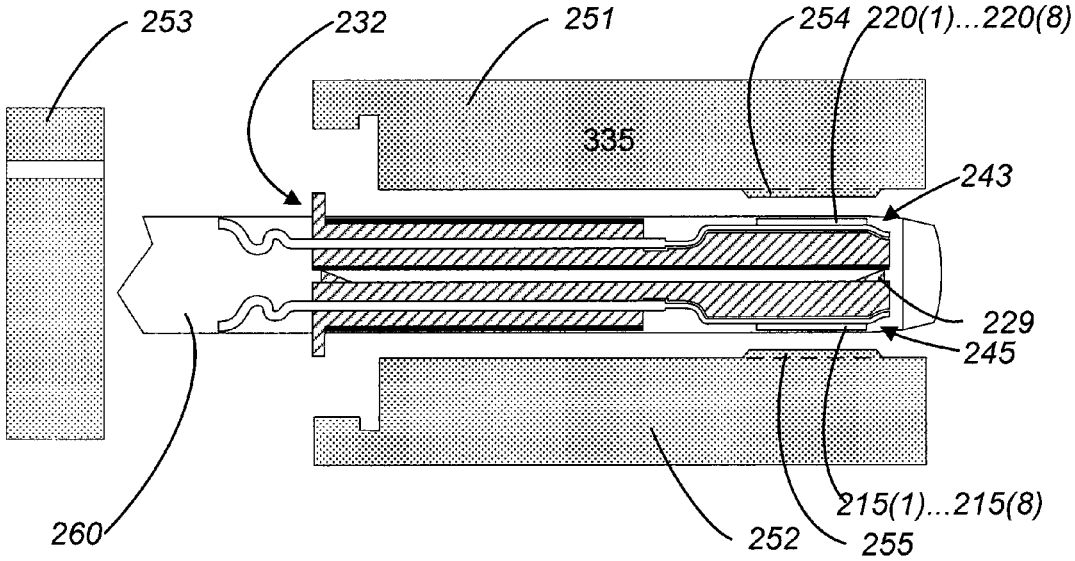
FIG. 2G is a cross-section illustration of an insert molding operation of a partially assembled dual orientation plug connector.
Figure 2H:
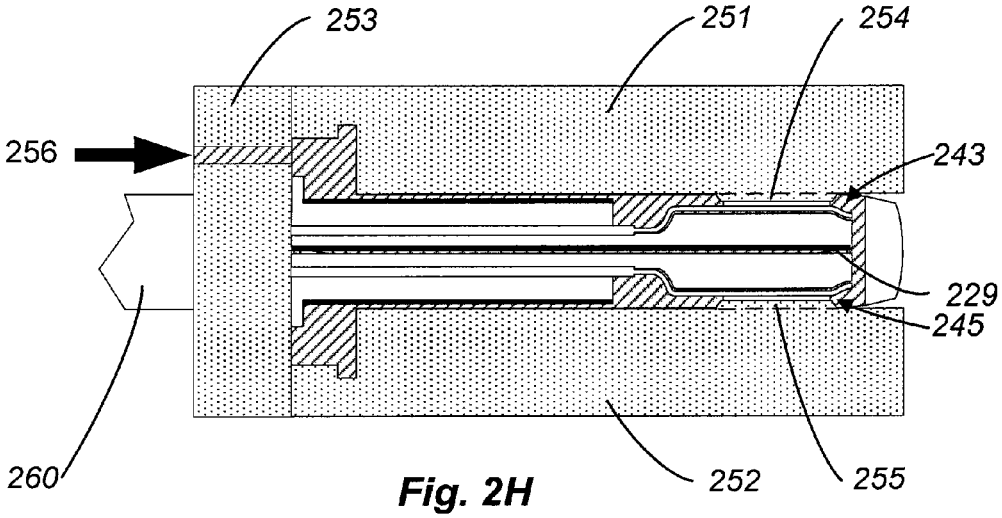
FIG. 2H is a cross-section illustration of an insert molding operation of a partially assembled dual orientation plug connector.
Figure 2I:
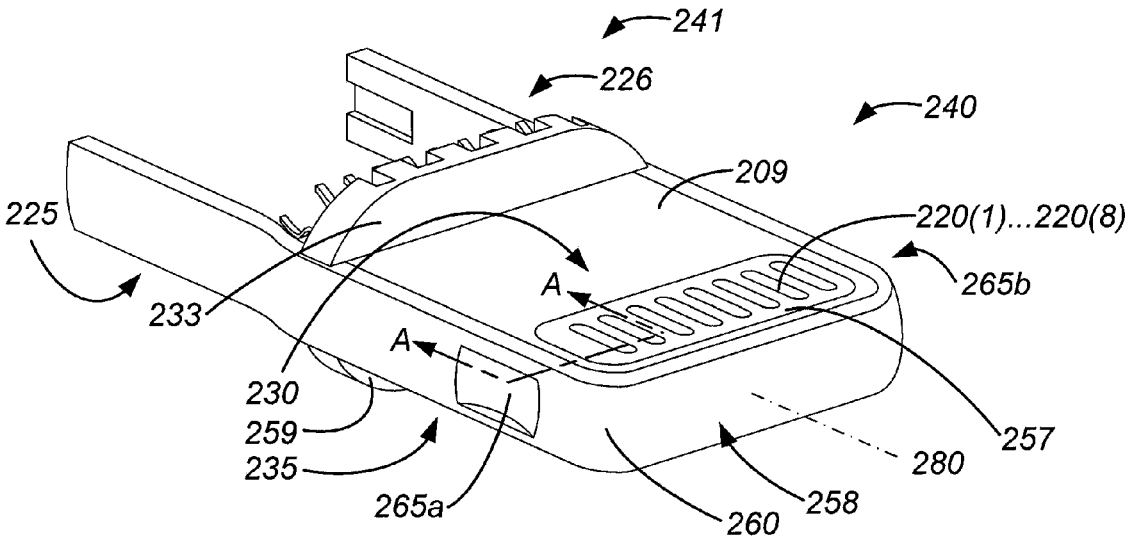
FIG. 2I is a front perspective view of a partially assembled dual orientation plug connector.
Figure 2J:
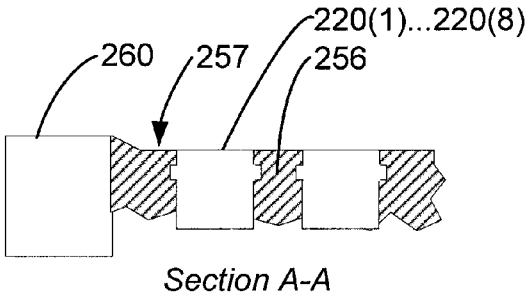
FIG. 2J is an illustration of a cross-section of a partially assembled dual orientation plug connector.
Figure 2K:
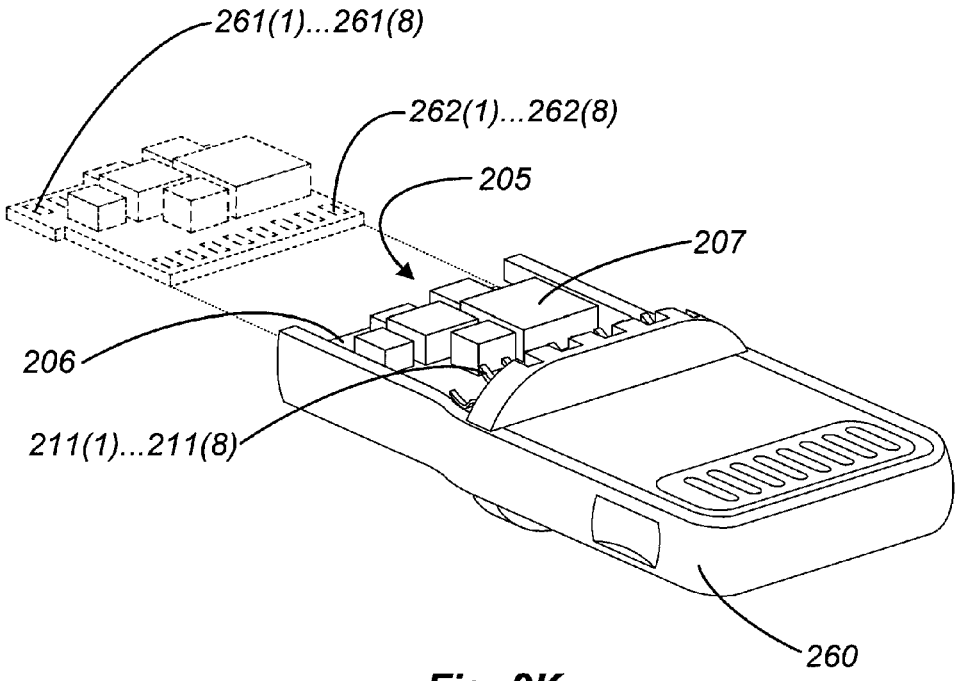
FIG. 2K is a front perspective view of a partially assembled dual orientation plug connector.
Figure 2L:
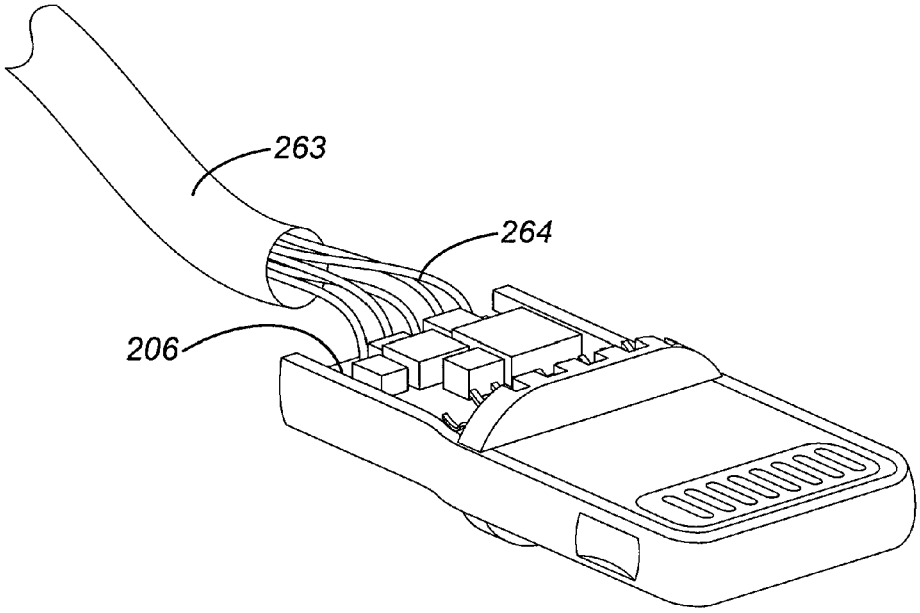
FIG. 2L is a front perspective view of a partially assembled dual orientation plug connector and a cable.
Figure 2M:
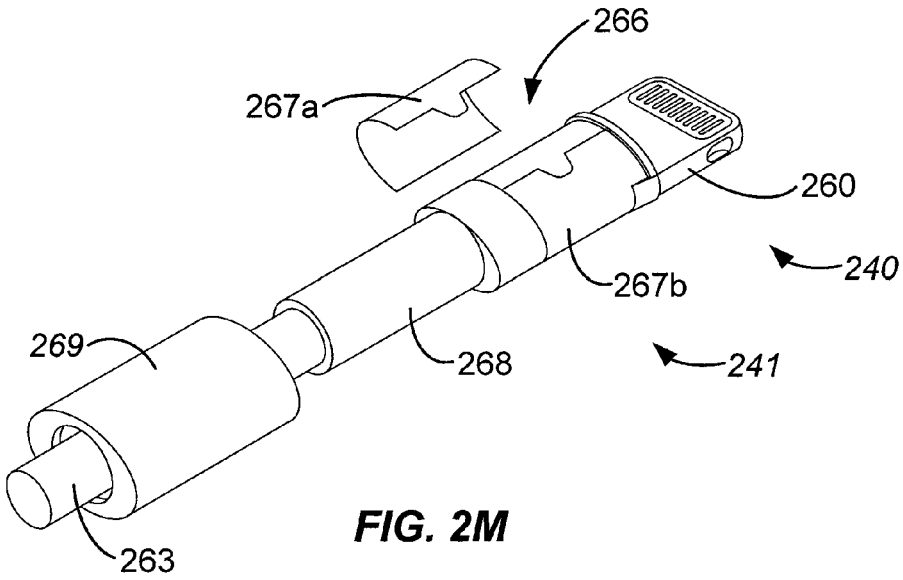
FIG. 2M is a rear perspective view of a partially assembled dual orientation plug connector, a cable and an enclosure.
Figure 2N:
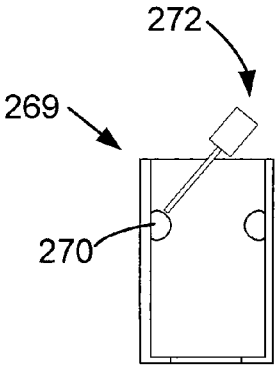
FIG. 2N is an illustration of a cross-section of an enclosure for a dual orientation plug connector.
Figure 2O:
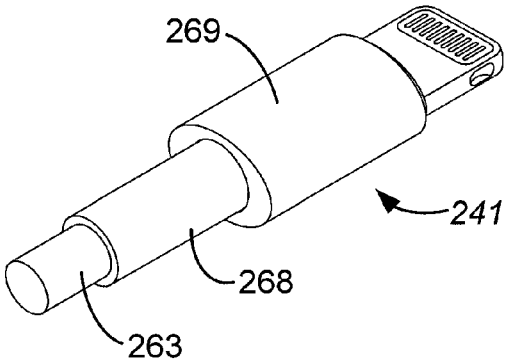
FIG. 2O is rear perspective view of an assembled dual orientation plug connector attached to a cable.
Figure 3:
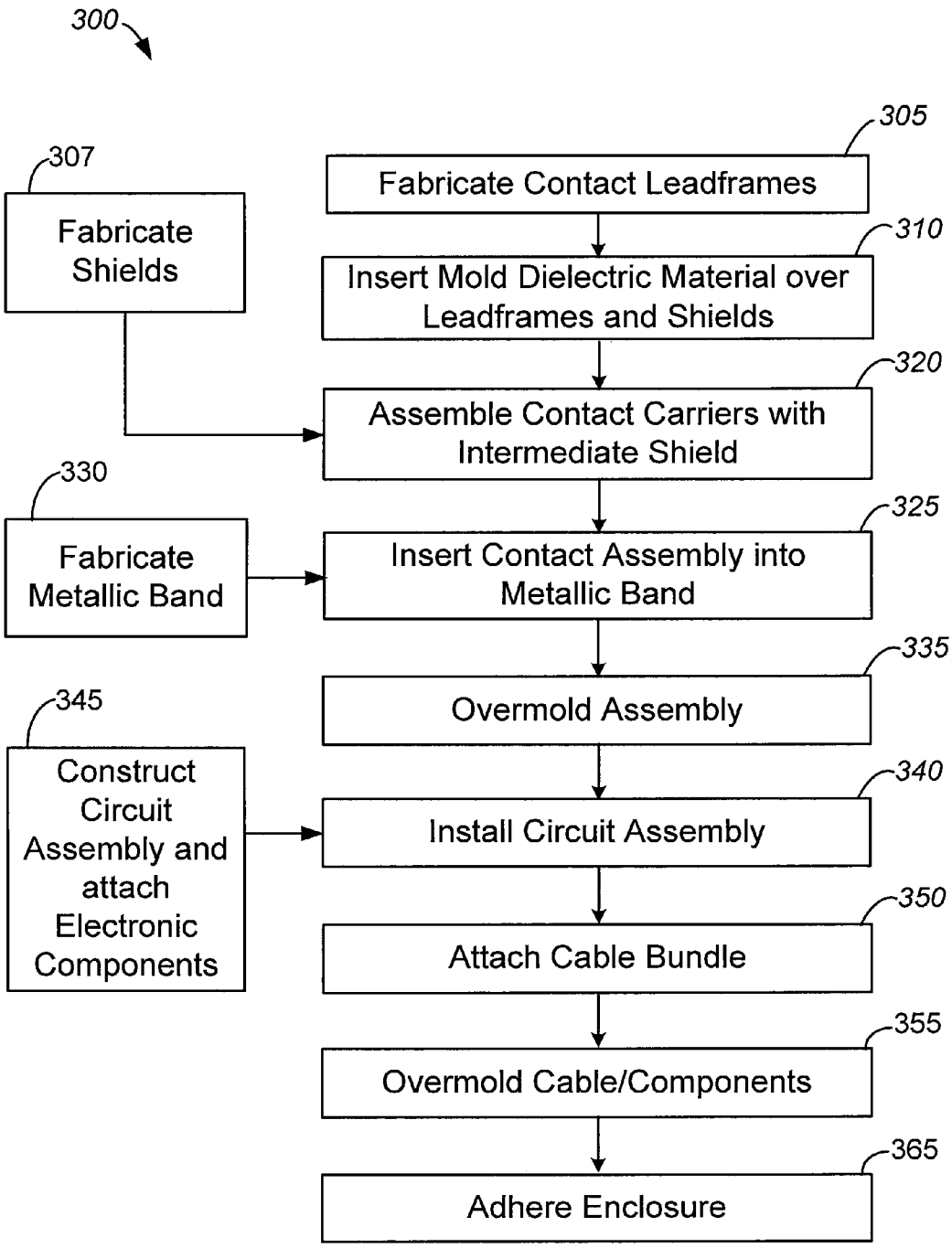
FIG. 3 is a process for the manufacture of a dual orientation plug connector attached to a cable.

Reference is now made to FIGS. 2A-2O and 3, regarding the steps associated with the manufacture and assembly of connector 200. FIG. 3 is a flow chart that illustrates the general steps associated with the manufacture and assembly of connector 200 according to one embodiment of the invention. FIGS. 2A-2O depict connector 200 at the various stages of manufacture set forth in FIG. 3.

Now referring to FIGS. 2C and 2D, the manufacture of connector 200 may be initiated with the fabrication of upper leadframe set 201 and lower leadframe set 202. Upper and lower leadframe sets 201, 202 may be manufactured using a reel-to-reel or other manufacturing process as is known in the art. In one embodiment, a de-spooling reel may contain a length of raw leadframe material. Raw leadframe material may be any type of metal, including alloys. In some embodiments upper and lower leadframe sets 201, 202 are made from copper or a copper alloy like phosphor-bronze, for example. In one embodiment the raw leadframe material is an alloy of phosphor-bronze and is less than one mm thick. The de-spooling reel may rotate in a counter-clockwise direction and allow raw leadframe material to enter one or more sets of die that blank and/or form upper and lower leadframe sets 201, 202 from the raw material. This cycle may repeat many times per minute. Processed leadframe material may exit the die set and be wound upon a re-spooling reel. Because of the cyclical nature of the die set, the blanked and/or formed features may be repeated patterns separated by a pitch. Thus, the processed leadframe material may be illustrated by representative upper and lower leadframe sections 203, 204 shown in FIGS. 2B and 2C.

Upper leadframe section 203 may include one or more carriers 208*a*, 208*b* that retain upper leadframe set 201. Upper leadframe set 201 may include a plurality of leads 210(1) . . . 210(8), wherein each lead has a contact portion 220(1) . . . 220(8) and a termination portion 211(1) . . . 211(8). Similarly, lower leadframe section 204 may include one or more carriers 212*a*, 212*b* that retain lower leadframe set 202. Lower leadframe set 202 may include a plurality of leads 213(1) . . . 213(8), wherein each lead has a contact portion 215(1) . . . 215(8) and a termination portion 214(1) . . . 214(8).

After the upper and lower leadframe sets 201, 202 are formed, they may be cleaned and plated while still attached to carriers 208*a*, 208*b*, 212*a*, 212*b* with a reel-to-to reel process similar to that discussed above. A de-spooling reel may contain a length of blanked and formed leadframe material. The de-spooling reel may rotate in a counter-clockwise direction and allow blanked and formed leadframe material to enter one or more cleaning and plating baths. The cleaned and plated leadframe material may exit the cleaning and plating baths and be wound upon a re-spooling reel. In one embodiment the blanked and formed leadframe material may go through three washing processes, a nickel plating process and a gold plating process. Myriad cleaning and plating processes may be used, including selective plating, without departing from the invention. Upper and lower leadframe sets 201, 202 may be plated with the same or with different processes.

The next step of assembly may involve fabricating upper shield 218, intermediate conductive plate 244 and lower shield 231 (FIG. 3, step 307; FIG. 2B). Shields 218, 244, 231 may be fabricated with a similar reel to reel method as described above, or another process may be used, such as but not limited to, single stage processing or chemical etching. Shields 218, 244, 231 may be formed from any metal or metal alloy. In one embodiment, shields 218, 244, 231 are formed from 304 stainless steel and may be plated with nickel.

Upper shield 218 may have one or more windows 219 to facilitate insert molding, as described in more detail below. Upper shield 218 may also have one or more latches 216*a*, 216*b* and one or more leads 217 that may be coupled to circuit assembly 205 (see FIG. 2A). Intermediate conductive plate 244 may have one or more alignment features 222*a*, 222*b* and one or more leads 242 that may be coupled to circuit assembly 205 (see FIG. 2A). Lower shield 231 may have one or more windows 236 to facilitate insert molding, as described in more detail below. Lower shield 231 may also have one or more latches 234*a*, 234*b* and one or more leads 237 that may be coupled to circuit assembly 205 (see FIG. 2A).

The next step of assembly may involve the simultaneous insert-molding of a dielectric plastic material around upper leadframe set 201(see FIG. 2C) and upper shield 218 to form upper contact carrier 243 (FIG. 3, step 310; FIG. 2B). In other embodiments, only the leadframe set may be insert molded and the shield may be installed later. Insert-molding may be accomplished with a system that looks and functions similar to a reel-to-reel blanking and forming machine discussed above. In one embodiment, a set of dies close on upper leadframe set 201 (see FIG. 2C) and upper shield 218, holding them in place while a dielectric material is injected around them, within the dies. Windows 219 may be used by the dies to secure upper leads 210(1) . . . 210(8) in place during the molding operation. Upper contact carrier 243 may then essentially be a unitary structure and thus lead frame carriers 208*a*, 208*b* (see FIG. 2C) may be removed. The dies open and a new upper leadframe set 201 (see FIG. 2C) may be advanced into the dies. This cycle may repeat several times per minute. In some embodiments, upper shield 218 may not be insert molded and may be installed in a subsequent step. In other embodiments, upper leadframe set 201 (see FIG. 2C) may not be insert molded and may be snapped or installed in a pre-molded dielectric structure. Other manufacturing processes known to those of skill in the art may be employed without departing from the invention. Lower leadframe carrier 245 may be manufactured in a similar way wherein lower leadframe set 202 (see FIG. 2D) and lower shield 231 are simultaneously insert molded with a dielectric material, becoming a unitary structure. Some embodiments may employ a thermoplastic material as the dielectric plastic material while other embodiments may employ a thermoset material. In one embodiment a liquid crystal polymer is used as the dielectric plastic.

The next step of assembly may involve the assembly of the upper contact carrier 243, intermediate conductive plate 244 and lower contact carrier 245, forming contact assembly 232 (FIG. 3, step 320; FIG. 2B, 2E). In some embodiments, upper contact carrier 243 may have one or more alignment bosses 224 that interface with intermediate conductive plate 244 alignment features 222*a*, 222*b* and lower contact carrier 245 alignment sockets 228. Such features may enable proper alignment and orientation of the components during the assembly operation. In addition, upper shield 218 latches 216*a*, 216*b* may mate with lower shield 231 latches 234*a*, 234*b* to retain upper contact assembly 243 mated to lower contact assembly 245. In further embodiments, lower contact assembly 245 may have one or more crushable bosses 229 that create a defined space between upper contact assembly 243 and lower contact assembly 245, as will be discussed in more detail below. In some embodiments, intermediate conductive plate 244 may not be used, particularly when signal isolation may not be required between upper and lower leadframe sets 201, 202. However, where isolation between upper and lower leadframe sets 201, 202 may be required, intermediate conductive plate 244 may be connected to a ground. In further embodiments, intermediate plate 244, upper shield 218, lower shield 231 and metallic band 260 may all be connected to ground to improve isolation and/or shielding performance of connector 200. Contact assembly 232 has an end surface 274, opposing first and second surfaces 275, 276 and third and fourth opposing side surfaces 277, 278 extending between the first and second surfaces.

The next step of assembly may involve the fabrication of metallic band 260 (FIG. 3, step 330; FIG. 2E). Metallic band 260 may be fabricated using a variety of techniques such as, for example, stamping, wire forming, forging, metal injection molding (MIM), cold heading or a billet machining process.

In some embodiments, alternative processes such as plastic injection molding and post plating with a metal may be used to form metallic band 260. Metallic band 260 may be substantially u-shaped and have a tab region 248 with a larger gap than a body region 249. As discussed above, metallic band 260 may have retention features 265*a*, 265*b*. Metallic band 260 may also have one or more alignment features 247*a*, 247*b* and contact assembly retention features 246*a*, 246*b* for aligning and retaining contact assembly 232 and/or circuit assembly 205 in metallic band 260. In some embodiments, metallic band 260 may be formed from a metal or metal alloy. In one embodiment, metallic band 260 is formed from stainless steel. In further embodiments, metallic band 260 may be plated with a metal, such as but not limited to, nickel or gold.

The next step of assembly may involve installing contact assembly 232 in metallic band 260 creating a partially assembled connector 250 (FIG. 3, step 325; FIGS. 2E, 2F). Contact assembly 232 may align with alignment features 247*a*, 247*b* and engage with contact assembly retention features 246*a*, 246*b*. Once engaged, contact assembly 232 may be physically retained within metallic band 260.

The next step of assembly may involve placing partially assembled connector 250 in an insert molding tool 251, 252, 253 and forming a dielectric encapsulant 256 around contact assembly 232 (FIG. 3, step 335; FIGS. 2G-2I). This process may provide smooth and substantially flat mating surfaces in the contact regions of plug 200. FIGS. 2G and 2H illustrate the insert molding process of one embodiment. An upper insert molding tool 251 and lower insert molding tool 252 may be configured to seal against the outer surfaces metallic band 260. An upper insert molding tool step 254 on upper insert molding tool 251 may simultaneously seal against the top surfaces of contacts 220(1) . . . 220(8). A lower insert molding tool step 255 on lower insert molding tool 252 may simultaneously seal against the top surfaces of contacts 215 (1) . . . 215(8). Steps 254, 255 may compress upper contact assembly 243 (see FIG. 2D) against lower contact assembly 245 wherein crushable bosses 229 deform such that contacts 220(1) . . . 220(8) can be a precise and controlled distance from contacts 215(1) . . . 215(8). A rear mold tool 253 may be used to entirely enclose the mold system. A first enclosure close-out 233 may be formed on the first exterior surface 230 and a second enclosure close-out 259 may be formed on second exterior surface 235.

To simultaneously seal all of these surfaces and protect against dielectric encapsulant 256 bleeding, insert mold tool 251, 252, 253 may be equipped with spring loaded inserts to accommodate dimensional variations of connector components. Insert mold tool 251, 252, 253 may also be configured to inject dielectric encapsulant 256 from the rear of the connector, or in other embodiments it may be injected in other locations. In one embodiment the insert mold tool has a recessed gate for injecting dielectric encapsulant 256. Dielectric encapsulant 256 is formed within metallic band 260 over first and second surfaces 275, 277 (see FIG. 2E) of contact assembly 232 such that contacts 220(1) . . . 220(8) of each lead 210(1) . . . 210(8) of upper lead frame set 201 are exposed on first exterior surface 230 of plug connector 200 and contacts 215(1) . . . 215(8) of each lead 213(1) . . . 213(8) of lower lead frame set 202 are exposed on second exterior surface 235 of the plug connector.

In some embodiments, dielectric encapsulant 256 may be polyoxymethylene (POM). In other embodiments, dielectric encapsulant 256 may be a nylon-based polymer that may be filled with glass fiber. Further embodiments may employ other materials.

FIG. 2I depicts one embodiment after the insert molding process. In some embodiments, a mating surface 257 may be disposed below first exterior surface 230 of connector 200 and be substantially coplanar with the top surface of contacts 220(1) . . . 220(8). FIG. 2J shows a simplified cross-section A-A of FIG. 2I in the region of mating surface 257. From this illustration it can be seen that mating surface 257 may reside in a depression below first exterior surface 230. In some embodiments the depression may be between 0.01 to 0.1 mm below the top surface of metallic band 260. This depression may protect contacts 220(1) . . . 220(8) from touching surfaces, such as that of a mating device, potentially causing damage to the top surface of the contacts. In further embodiments the recess may be deeper in some areas and shallower in others. In other embodiments the recess may be deeper towards the rear of the connector and substantially coplanar with the top surface of metallic band 260 towards a distal end 258 of connector 200. In yet further embodiments, mating surface 257 of dielectric encapsulant 256 may be substantially coplanar with metallic band 260. As defined herein, electrical contacts disposed on an exterior surface shall mean generally on the exterior surface of the connector including embodiments where the contacts are coplanar with an outer surface of metallic band 260 and where the contacts reside in a depression below the outer surface of metallic band 260.

The next step of assembly may involve constructing circuit assembly 205 (FIG. 3, step 345; FIG. 2K). PCB 206 may be a traditional epoxy and glass combination or may be any equivalent structure capable of routing electrical signals. For example, some embodiments may use a flexible structure comprised of alternating layers of polyimide and conductive traces while other embodiments may use a ceramic material with conductive traces or a plastic material processed with laser direct structuring to create conductive traces. PCB 206 may be formed with a set of conductor bonding pads 261(1) . . . 262(8) disposed at one end and a set of termination bonding pads 262(1) . . . 262(8) disposed at the opposing end. Additionally, a set of component bonding pads (not shown) may be formed on PCB 206 to electrically connect one or more active or passive electronic components 207 such as, for example, integrated circuits (ICs), resistors or capacitors. The embodiments depicted herein are for exemplary purposes only, other embodiments may have a different arrangement of bonding pads 261(1) . . . 261(8), 262(1) . . . 262(8) more or less bonding pads, as well as bonding pads formed on either or both of the opposing sides of PCB 206, and fewer, more or different electronic components 207.

Example electronic components 207 are depicted on one side of PCB 206 (see FIG. 2K), however in other embodiments electronic components 207 may be on either or both sides of PCB 206. In some embodiments a conductive epoxy may be used to electrically attach electronic components 207 to PCB 206. In other embodiments a solder alloy may be employed using myriad technologies such as, for example, through-hole mounting, stencil print and reflow, chip-on-board, flip-chip or other appropriate connection method. In one embodiment a stencil printing process is used to dispose solder paste on component bonding pads (not shown). Electronic components 207 may then be disposed on the solder paste and a convective heating process can be used to reflow the solder paste, attaching the electronic components to PCB 206. The solder alloy may be a lead-tin alloy, a tin-silver-copper alloy, or other suitable metal or metallic alloy.

In some embodiments, during electronic component 207 attachment process, solder paste may be deposited on termination bonding pads 262(1) . . . 262(8) and/or conductor bonding pads 261(1) . . . 261(8), and reflowed. In some embodiments, after electronic components 207 are attached to PCB 206, circuit assembly 205 may be washed and dried. However, in other embodiments circuit assembly 205 may not be washed until subsequent processing. In other embodiments a no-clean flux is used to aid the soldering process and there is no wash process. In further embodiments a no-clean or a cleanable flux is used to aid the soldering process and the assembly is washed. Finally, some or all of electronic components 207 may be encapsulated with a protective material such as, for example, an epoxy, a urethane or a silicone based material. In some embodiments the protective encapsulant may provide mechanical strength for improved reliability and/or environmental protection from moisture for sensitive electronic components. In further embodiments the protective encapsulant may improve the dielectric breakdown voltage performance of connector 200. The encapsulant may be applied with an automated machine or with a manual dispenser.

The next step of assembly may involve installing circuit assembly 205 in the partially assembled connector (FIG. 3, step 340; FIGS. 2K, 2L). FIG. 2K depicts circuit assembly 205 being inserted into metallic band 260 such that termination pads 262(1) . . . 262(8) mate with termination portion 211(1) . . . 211(8) of leads 213(1) . . . 213(8) (see FIG. 2C). Termination portion 211(1) . . . 211(8) of leads 213(1) . . . 213(8) are then electrically connected to termination bonding pads 262(1) . . . 262(8) by solder, conductive epoxy or other method.

When connector 200 is part of a cable, the next step of assembly may comprise attaching a cable bundle 263 to the partially assembled connector (FIG. 3, step 350; FIG. 2K). Cable bundle 263 may have individual conductors (e.g., wires) 264, for attachment to conductor bonding pads 261(1) . . . 261(8) of PCB 206. Individual conductors 264 may be cut and stripped and the jacket of cable bundle 263 may also be cut and stripped. Each conductor 264 may be soldered to its respective conductor bonding pad 261(1) . . . 261(8) using an automated, a semi-automated or a manual process. In one embodiment conductors 264 are aligned in a fixture and each conductor is automatically soldered to each conductor bonding pad 261(1) . . . 261(8). In another embodiment each conductor 264 is welded to its respective conductor bonding pad 261(1) . . . 261(8). In some embodiments, where connector 200 is part of an electronic device or accessory that does not attach a cable to the connector, for example, a docking station, individual wires, a flex circuit or the like may electrically connect conductor bonding pad 261(1) . . . 261(8) to circuitry in the device. Myriad conductor attachment processes may be used without departing from the invention.

When connector 200 is part of a cable, the next step of assembly may comprise overmolding cable bundle 263 to the partially assembled connector (FIG. 3, step 355; FIG. 2M). In such instances, the next step of assembly may involve overmolding a portion of the connector, including electronic components 270 (see FIG. 2K) attached to PCB 206. A first insert molding operation may be performed, encapsulating circuit assembly 205 (see FIG. 2K) in plastic material, and forming a body 266 of connector 200. A second insert molding process may be performed afterwards creating a strain relief sleeve 268 attached to the rear face of connector body 266 and extending over cable 263 for a short distance. In some embodiments connector body 266 may be made partially from insert molded plastic and partially from other materials. The first and second insert molding materials may be any type of plastic or other non-conductive material. In one embodiment, both materials are thermoplastic elastomers wherein the second insert molding material is of a lower durometer than the first insert molding material. FIG. 2M depicts an embodiment with a two piece conductive metal shield 267*a*, 267*b* that may be installed over a portion of connector body 266 and electrically coupled to metallic band 260. In some embodiments, shield 267*a*, 267*b* may be installed first and connector body 266 may be molded in a subsequent operation. In some embodiments, shield 267*a*, 267*b* may be welded to metallic band 260. In some embodiments shield 267*a*, 267*b* may be made from steel while in other embodiments copper or tin alloys may be used.

The next step of assembly may involve attaching an enclosure 269 to body 266 (FIG. 3, step 365; FIGS. 2M-2O). In FIG. 2M, enclosure 269 is illustrated in a preassembled position, located on cable bundle 263. Enclosure 269 may be sized appropriately to slide over connector body 266, substantially enclosing the connector body within the enclosure. Enclosure 269 can be manufactured from any type of plastic or other non-conductive material and in one embodiment is made from ABS.

A cross-sectional view of enclosure 269 is shown in FIG. 2N. This figure further depicts bonding material 270 deposited on two locations on an inside surface of enclosure 269. Bonding material 270 may be deposited with a syringe and needle assembly 272 as shown, or it can be deposited with myriad other techniques without departing from the invention. The final assembly step is shown in FIG. 2O and comprises sliding enclosure 269 over connector body 266 until the enclosure substantially encloses the connector body.

Bonding material 270 may be cured, adhering the inside surface of enclosure 269 to the outside surface of connector body 266. In some embodiments bonding material 270 may be a cyanoacrylate that cures in the presence of moisture. In other embodiments bonding material 270 may be an epoxy or urethane that is heat cured. Other bonding materials are well known in the art and may be employed without departing from the invention.

In the foregoing specification, embodiments of the invention have been described with reference to numerous specific details that may vary from implementation to implementation. The specification and drawings are, accordingly, to be regarded in an illustrative rather than a restrictive sense. The sole and exclusive indicator of the scope of the invention, and what is intended by the applicants to be the scope of the invention, is the literal and equivalent scope of the set of claims that issue from this application, in the specific form in which such claims issue, including any subsequent correction.

What is claimed is:

1. An axisymmetric dual orientation plug connector comprising:

a contact assembly comprising a first plurality of leads insert molded within a first contact carrier, a second plurality of leads insert molded within a second contact carrier and an intermediate conductive plate sandwiched between the first and second contact carriers, the contact assembly having an end surface, opposing first and second surfaces and third and fourth opposing side surfaces extending between the first and second surfaces;

a substantially u-shaped metallic band disposed around a periphery of the contact assembly such that the metallic band surrounds the end surface and the third and fourth opposing side surfaces of the contact assembly; and dielectric encapsulant formed within the metallic band over the first and second surfaces of the contact assembly such that a contact portion of each lead of the first plurality of leads is exposed on a first exterior surface of the plug connector and a contact portion of each lead of the second plurality of leads is exposed on a second exterior surface of the plug connector;

wherein the first and second exterior surfaces of the plug connector are substantially identical, parallel and opposite each other.

2. The dual orientation plug connector set forth in claim 1 wherein the contact assembly is at least partially enclosed by a metallic shield and the dielectric encapsulant completely covers the metallic shield.

3. The dual orientation plug connector set forth in claim 2 wherein the metallic shield is electrically connected to the intermediate conductive plate.

4. The dual orientation plug connector set forth in claim 2 further having a body portion and a tab that extends from the body portion, and wherein the metallic band extends along an entire length of the tab and includes first and second opposing extensions bent inward within the body portion.

5. The dual orientation plug connector set forth in claim 1 wherein each lead of the first and second plurality of leads has a termination portion that extends beyond its respective contact carrier and is connected to a circuit assembly.

6. The dual orientation plug connector set forth in claim 1 wherein the plug connector may be mated with a matching receptacle connector in a first orientation and the plug connector must be rotated 180 degrees along a longitudinal axis to mate with the receptacle connector in a second orientation.

7. The dual orientation plug connector set forth in claim 1 wherein the metallic band comprises recesses formed in opposing side surfaces.

8. The dual orientation plug connector set forth in claim 1 wherein the first and second pluralities of leads are electrically connected to a circuit assembly that is at least partially disposed within the metallic band.

9. The dual orientation plug connector set forth in claim 8 wherein the circuit assembly is further connected to an electrical cable.

10. A connector plug comprising:

a substantially u-shaped electrically conductive band defining a distal end and opposing side surfaces of the connector plug;

an overmolded leadframe assembly disposed at least partially within the band defining first and second exterior surfaces of the connector plug;

the overmolded leadframe assembly further comprising a first set of electrical leadframes insert molded in a first leadframe carrier and disposed on the first exterior surface and a second set of electrical leadframes insert molded in a second leadframe carrier and disposed on the second exterior surface wherein each of the first and second set of electrical leadframes each have a distal contact portion coupled to a termination portion; and an intermediate conductive plate disposed between the first and second leadframe carriers.

11. The connector plug set forth in claim 10 wherein the distal contact portions of the first and second electrical leadframes are located proximate the distal end of the connector plug.

12. The connector plug set forth in claim 11 wherein the termination portions of the first and second sets of electrical leadframes are electrically connected to a circuit board that is disposed at least partially within the conductive band.

13. The connector plug set forth in claim 12 wherein the circuit board is connected to an electrical cable.

14. The connector plug set forth in claim 10 wherein the conductive band further comprises recesses formed within the opposing side surfaces.

15. The connector plug set forth in claim 10 wherein a first shield is disposed below the first exterior surface and a second shield is disposed below the second exterior surface.

16. The connector plug set forth in claim 15 wherein the first and second shields are electrically connected to the intermediate conductive plate.

17. The connector plug set forth in claim 10 further configured to be mated with a matching receptacle connector in a first orientation and the connector plug must be rotated 180 degrees along a longitudinal axis to mate with the receptacle connector in a second orientation.

18. The connector plug set forth in claim 10 wherein the leadframe assembly is at least partially enclosed by a metallic shield and a dielectric encapsulant completely covers the metallic shield.

19. The connector plug set forth in claim 18 wherein the metallic shield is electrically coupled to the intermediate conductive plate.

20. The connector plug set forth in claim 10 further having a body portion and a tab that extends from the body portion, and wherein the conductive band extends along an entire length of the tab and includes first and second opposing extensions bent inward within the body portion.

* * * * *